United States Patent [19]

Dolson

[11] Patent Number: 4,510,378

[45] Date of Patent: Apr. 9, 1985

[54] PORTABLE VOTING BOOTH

[75] Inventor: Richard G. Dolson, Canton, Conn.

[73] Assignee: Veeder Industries Inc., Hartford, Conn.

[21] Appl. No.: 543,392

[22] Filed: Oct. 19, 1983

[51] Int. Cl.[3] ..... G07C 13/00

[52] U.S. Cl. ..... 235/50 R; 312/237; 312/244; 312/258

[58] Field of Search ..... 235/50 R–50 B, 235/52, 51; 312/237, 258, 262, 3, 5

[56] References Cited

U.S. PATENT DOCUMENTS

| | | | |
|---|---|---|---|
| 3,181,785 | 5/1965 | Laws et al. | 235/52 X |
| 3,654,709 | 4/1972 | Martin et al. | 235/51 X |
| 3,806,219 | 4/1974 | Ahmann | 312/258 X |
| 4,451,728 | 5/1984 | McKay et al. | 235/50 R |

*Primary Examiner*—Benjamin R. Fuller

*Attorney, Agent, or Firm*—Prutzman, Kalb, Chilton & Alix

[57] ABSTRACT

A portable voting booth is pivotally positionable in a compact storage mode and an expanded voting mode. The voting booth comprises a base storage container and a support console pivotally mounted to the container. A voting console having a ballot means is pivotally mounted to the display console. A pair of panels are connected to the voting console in a generally upright voting mode. The base container forms a generally horizontally disposed base support. The support console and voting console are in generally upright relationship with the booth means being rearwardly supported and forming a generally forward overhang structure. Means are also provided to lower the ballot display to a position for access by handicapped voters.

40 Claims, 15 Drawing Figures

PORTABLE VOTING BOOTH

BACKGROUND OF THE INVENTION

This invention relates to a portable voting booth which is adaptable for use for voting purposes and may be readily transformed to a configuration suitable for storage. More particularly this invention relates to a generally unitary expandable voting booth which is also adaptable for use in conjunction with an electronic voting means.

The portable voting booth of the present invention provides a voting booth which may be collapsed to a compact storage configuration to facilitate the storage and the transporting of the booth. The portable voting booth is also efficiently expandable to a voting mode to form a voting booth which may be suitably employed in conducting elections and/or other similar activities. The portable voting booth is especially adaptable for use in conjuction with an electronic voting means of a type employing a membrane-type ballot defining a keyboard system which actuates circuitry to record, verify and tabulate votes by electronic means. A preferred form of a keyboard system including a membrane display to which the present invention is especially adapted is disclosed in co-pending application Ser. No. 543,390 filed Oct. 19, 1983 which application is assigned to the assignee of the present invention.

BRIEF SUMMARY OF THE INVENTION

Briefly stated, the invention in a preferred form, is a portable voting booth which is expandable from a storage mode to a voting mode and is also collapsable form the voting mode back to the storage mode. The portable voting booth comprises a base storage container and a support console pivotally mounted to the container. A voting console having a ballot display means is pivotally mounted to the support console. A booth means is connected to the voting console and is expandable to visually isolate the ballot display means. In the storage mode, the booth means, voting console and support console are received in nestled relationship within the storage container. In the voting mode, the booth means, voting console and support console are expanded to a stable position wherein the ballot panel means is presented in a generally upright position relative to the container and the ballot panel means is visually isolatable by the booth means.

In a preferred form, the container has a generally box-like form mounting a pair of wheels at the rear and having a pair of slots at a front portion. A pair of arms extend outwardly through the slots to forwardly mount a stabilizer bar. The support console forms a lid for the container in the storage mode. The stabilizer bar functions so that the booth may be lowered to a handicapped position for facilitating use by handicapped individuals.

The support console is pivoted from the storage container and the voting console is pivoted relative to the support console to pivotally expand the voting booth from the storage mode to the voting mode. Counterbalancing means are provided to facilitate expansion of the voting booth.

The booth means preferably comprises a pair of doors which are hinged to the voting console and a pair of curtain rods pivotally mounted to the voting console. In the voting mode, the doors are opened and the curtain rods are supported by a support which projects from the doors. A curtain is suspended from a foldable curtain rod extension which mounts to the ends of the curtain rods. Latching means are also provided to secure the voting booth in a stable, expanded voting mode and to facilitate the efficient expanding of the voting booth to the voting mode and the collapsing of the voting booth to the storage mode.

An object of the invention is to provide a new and improved portable voting booth of rugged construction which is efficiently expandable from a storage mode to a voting mode.

An object of the invention is to provide a new and improved portable voting booth which is collapsable to a compact storage mode wherein the portable voting booth may be transported and stored in an efficient manner.

Another object of the invention is to provide a new and improved portable voting booth adapted for use in conjunction with an electronic voting means.

A further object of the invention is to provide a new and improved portable voting booth which is expandable to a generally upright position for presenting a ballot display for use by individuals in a normally standing position and may also be lowered to a stable position which allows for use of the voting booth by handicapped individuals.

A further object of the invention is to provide a new and improved portable voting booth having new and improved coordinated latching and counterbalancing means wherein the voting booth may be readily expanded and collapsed in an efficient and reliable manner.

Other objects and advantages of the invention will become apparent from the accompanying drawings and the detailed description.

DETAILED DESCRIPTION

Figure 1:
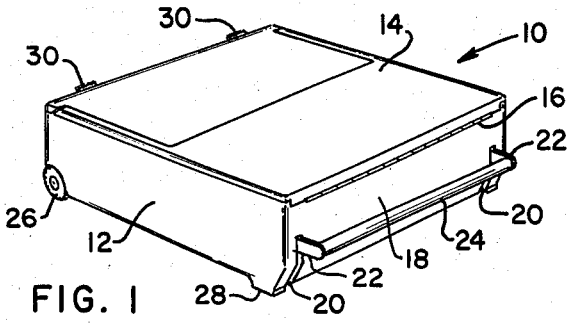
FIG. 1 is a perspective view of a portable voting booth of the present invention illustrated in a storage configuration.
Figure 2:
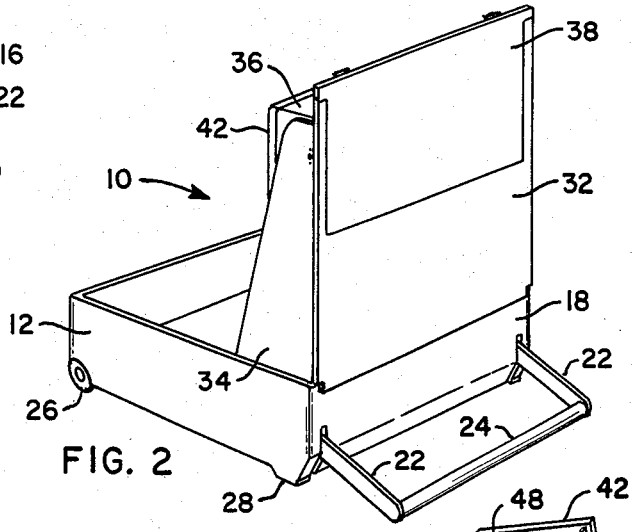
FIG. 2 is a perspective view of the portable voting booth of FIG. 1 illustrated in an intermediate expanded configuration.
Figure 3:
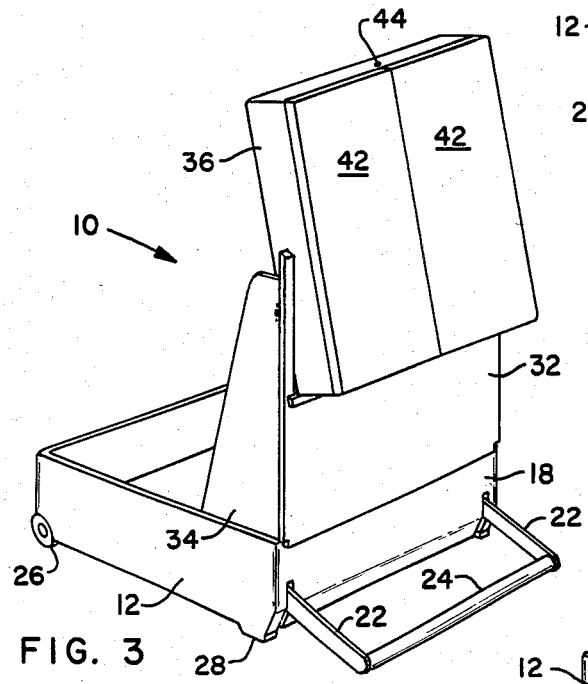
FIG. 3 is a perspective view of the portable voting booth of FIG. 1 illustrated in a second intermediate expanded configuration.
Figure 4:
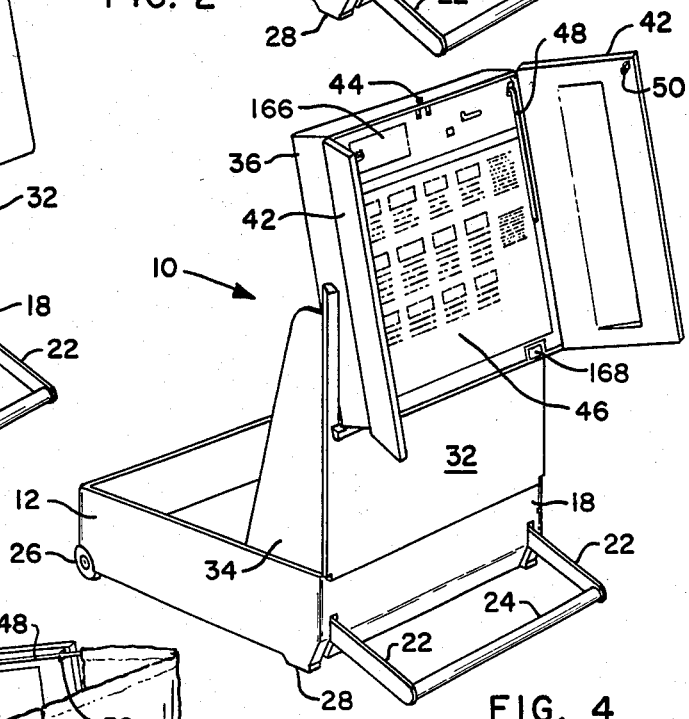
FIG. 4 is a perspective view of the portable voting booth of FIG. 1 illustrated in a third intermediate expanded configuration.
Figure 5:
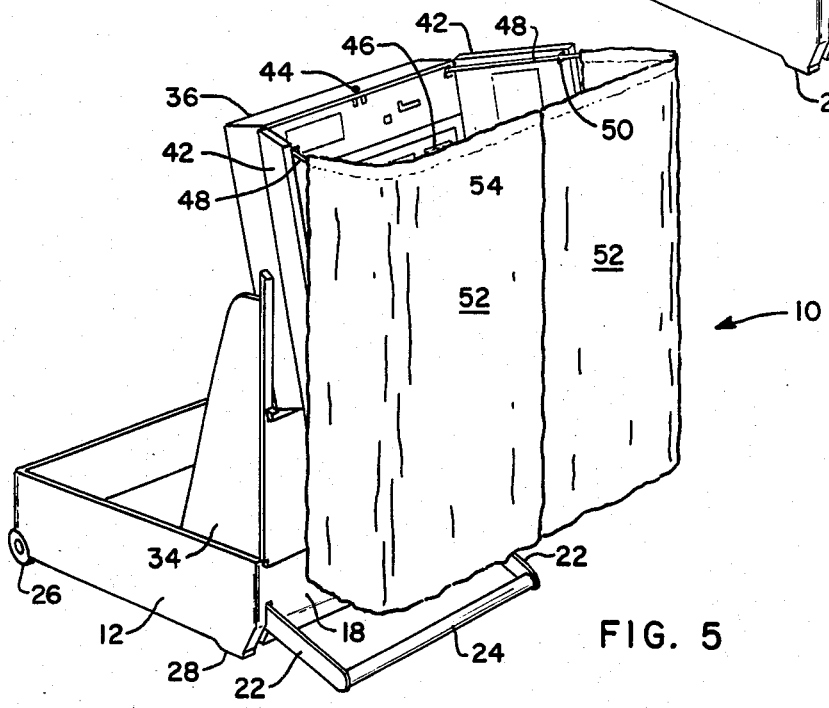
FIG. 5 is a perspective view of the portable voting booth of FIG. 1 illustrated in a voting configuration.

With reference to the drawings wherein like numerals represent like parts throughout the several drawings, a portable voting booth of the present invention is generally designated by the numeral 10. With specific reference to FIG. 1 through FIG. 5, portable voting booth 10 is of a substantially unitary form and is provided with a number of novel cooperating pivoting and latching means so that the voting booth may be efficiently collapsed to a compact storage configuration such as illustrated in FIG. 1 and the voting booth may also be efficiently expanded to the operational or voting configuration illustrated in FIG. 5. FIG. 1 through FIG. 5 sequentially illustrate in step-by-step fashion the expansion of voting booth 10 from the storage configuration to the voting configuration. FIG. 2 illustrates a first stage in the expansion of the voting booth from the storage configuration wherein a support console and voting console have been pivoted from a base container to a generally upright position. FIG. 3 illustrates a second stage in the expansion of the voting booth wherein the voting console has been forwardly pivoted relative to the support console. FIG. 4 illustrates a third stage in the expansion of the voting booth wherein front panels of the voting console have been opened. FIG. 5 illustrates the voting booth in the final expanded voting configuration wherein a curtain enclosure has been completed.

With reference to FIG. 1, voting booth 10 may be generally exteriorly described in the storage configuration as comprising a substantially box-like base 12 having an upper cover 14 which is hinged to base to 12 by an elongated hinge 16. Hinge 16 extends across a top front portion of the base 12. Base 12 includes a front base panel 18 having at opposite sides a pair of slots 20. A pair of stabilizer arms 22 extend outwardly through slots 20 to support a generally transverse stabilizer bar 24. Stabilizer bar 24 may be advantageously used as a convenient handle when the voting booth is in the storage configuration of FIG. 1. Base 12 exteriorly presents a generally smooth contoured form and is preferably a unitary molded component. One or more storage compartments may be interiorly formed in base 12.

Base 12 also mounts at the rear bottom portion a pair of wheels 26 (only one being illustrated). Each wheel 26 is located at opposite sides of base 12. The wheels function to facilitate the transporting of the portable voting booth. A pair of feet 28 are provided on the underside of base 12 at the front side portions thereof. At least one overlapping-type latch 30 secures the cover 14 in the closed position by latching the cover to the base 12 at the upper rear of the base. The voting booth is preferably stored in an upright position (not illustrated) wherein the booth is supported on the rear portion of the base 12 opposite front base panel 18.

After disengaging latch or latches 30, cover 14 may be upwardly and outwardly pivoted from base 12 to a substantially upright position such as illustrated in FIG. 2. Cover 14 includes a front support panel 32 which connects between a pair of substantially A-shaped frame members 34 (only one being illustrated in the drawings). A-frame members 34 are interiorly received in base 12 in the storage configuration and are pivotally positionable in an upright position relative to the base 12. A-frame members 34 are located at opposite sides of the voting booth interiorly of the sides of base 12. A-frame members 34 carry a generally box-like voting console 36 which is pivotally mounted at opposite sides between upper portions of the A-frame members 34. A-frame members 34 are preferably reinforced by means of a front perpendicularly disposed support member 40 which may be integral with front support panel 32. Cover 14 also may partially include a portion of the rear panel 38 of voting console 36. When the support console comprising A-frame members 34, front panel 32, and members 40 is in the upright position of FIG. 2, voting console 36 is upwardly pivotal in the clockwise direction of the drawings of FIG. 2 and FIG. 3 to the slightly inclined position illustrated in FIG. 3. In the configuration of FIG. 3, rear panel 38 abuts against support panel 32.

Voting console 36 is preferably constructed from molded components to form a generally smooth contoured exterior. Voting console 36 includes a pair of front panels 42 which are hinged at the front sides of the voting console. In the storage configuration, panels 42 are latched in a closed position against voting console 36 as illustrated in FIG. 3. A button 44 at the top of the voting console 36 may be depressed to unlatch panels 42 so that the panels may be opened to the position illustrated in FIG. 4. Exterior portions of front panels 42 contact against the front face of support members 40 to help prevent the voting console from pivotally collapsing to the configuration of FIG. 2 wherein the voting console is nestled in the support console. The opening of the front panels 42 accesses a ballot panel means designated generally as 46. Voting booth 10 is preferably employed in conjuction with an electronic voting means which is incorporated into voting console 36. In such a preferred application ballot panel means 46 may include a ballot display and a keyboard system such as disclosed in co-pending application Ser. No. 543,390 filed Oct. 19, 1983 entitled, "Keyboard System and Module Therefor" assigned to the assignee of the present invention. Alternately, ballot panel means may include a mechanical or electronic ballot means of conventional form or merely provide means for mounting or securing a voting or ballot means to present a generally frontally disposed display.

A pair of curtain rods 48 are pivotally mounted at one end to the top front portion of the voting console adjacent ballot panel means 46. Rods 48 are pivotally folded into console 36 when front panels 42 are in the latched position of FIGS. 1–3. When the front panels 42 are opened, the curtain rods 48 are accessible for manual positioning in a forward extended position. Curtain rods 48 may then be mountably secured to a latch/support member 50 which interiorly projects from each of the front panels 42. Visual isolation of the ballot panel means 46 is completed by mounting a curtain 52 to a substantially C-shaped foldable curtain rod extension 54 (only partially illustrated). Extension 54 is flared at each end to receive the ends of rods 48 to thereby securely mount the curtain to the voting booth and complete the booth enclosure as illustrated in FIG. 5.

The stabilizer arms 22 and stabilizer bar 24 are projected forwardly in the configurations of FIG. 2 through FIG. 5 to provide means for preventing the forward tipping of the portable voting booth when the booth is in the latter described upright configurations.

It should be appreciated that the foregoing described steps for expanding the portable voting booth to the operational or voting configuration illustrated in a step-by-step manner from FIG. 1 to FIG. 5 may be essentially reversed so that the portable voting booth may be collapsed from the configuration of FIG. 5 to the compact storage configuration illustrated in FIG. 1. It should be noted that the foldable curtain rod extension 54 and curtain 52 may be stored in a forward interior portion of the base 12. A more detailed description of the mechanical means for accomplishing the foregoing expanding and collapsing features of the portable voting booth 10 will be set forth below.

Having described the portable voting booth 10 of the present invention in general terms, it will be appreciated that the portable voting booth 10 may be collapsed or folded to a substantially compact storage configuration as illustrated in FIG. 1 and may be efficiently expanded to the operational or voting position such as illustrated in FIG. 5. In preferred form, the portable voting booth also mounts electronic circuitry for providing an electronic voting machine. The electronic circuitry, the actuation means, and the ballot display which are preferably employed and incorporated into the portable voting booth 10 are not the specific subject of this application. In general terms, the voting console 36 provides sufficient space and support for the various electronic circuitry as well as the ballot display, function keyboard, and voting actuation means that may be employed. Portions of the base 12 may be adapted to provide various means for connecting the electronic circuitry to an external power supply such as power cord storage, auxiliary battery storage, etc., none of which specific adaptations are the focus of the present invention.

Figure 6:
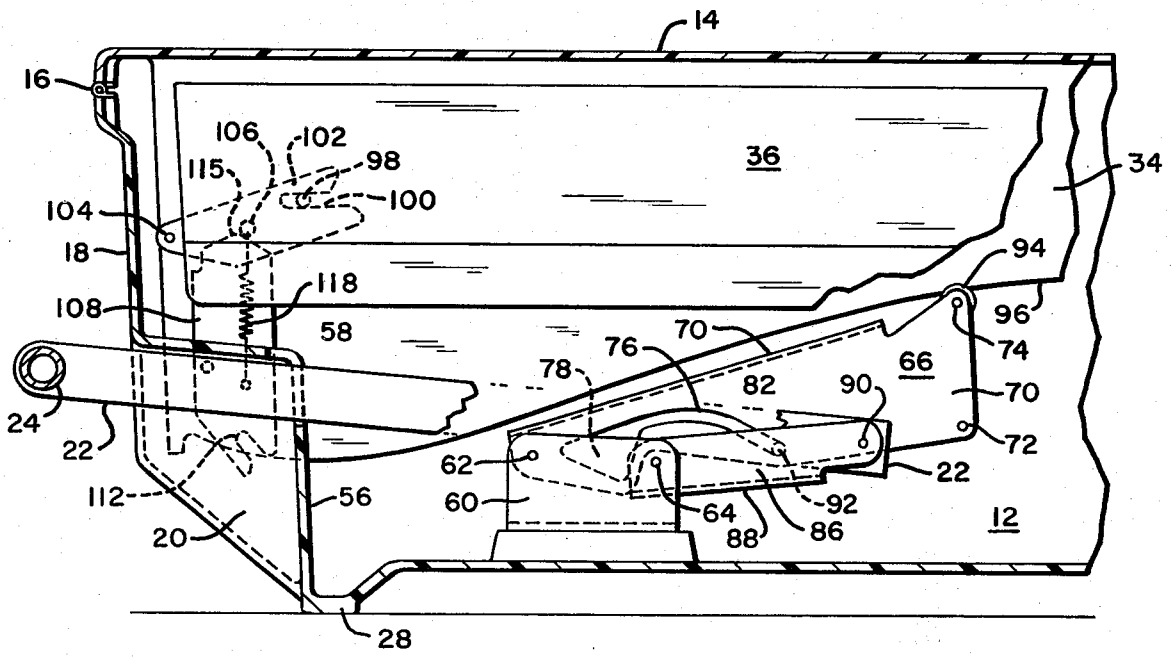
FIG. 6 is an interior side view of a portion of the portable voting booth in the configuration of FIG. 1, partially broken away and partially in phantom, illustrating a portion of a counterbalance/latch assembly employed in the present invention.

In preferred form, the foregoing described base 12, cover 14, A-frame members 34, voting console 36, and support members 40 are formed of heavy-duty plastic materials. In order to attain an efficient and reliable operation in terms of expanding and collapsing the voting booth as well as to provide sufficient stability to the voting booth, the voting booth 10 is provided with a number of coordinated latching and counterbalancing means. With reference to FIG. 6, a portion of a support latch/counterbalance assembly and an associated arm extension assembly are illustrated for the storage configuration of FIG. 1. A substantially identical support latch/counterbalance assembly and associated arm extension assembly are also provided at the opposite side of the voting booth. With reference to the storage configuration of FIG. 6, stabilizer arm 22 and stabilizer bar 24 are secured in a retracted storage position so that stabilizer bar 24 may be employed as a convenient handle for transporting and positioning the voting booth 10. Stabilizer arm 22 is maintained in a rigid locked position partially by means of a support shoulder 56 upwardly projecting from base 12 to engage stabilizer arm 22 at a lower portion and a cooperating support surface 58 formed in base 12 which engages against a top portion of stabilizer arm 22.

A generally U-shaped bracket support 60 is rigidly mounted to base 12 to present a pair of opposite support plates which receive opposite ends of parallel shafts 62 and 64. Shaft 62 pivotally mounts one end of a shock bracket 66. Shock bracket 66 is an elongated member having a substantially U-shaped intermediate cross section forming a pair of substantially parallel plates 68 and 70 (an edge of substantially hidden plate 68 is denoted by dashed lines). Plates 68 and 70 form at the other ends two pairs of complementary openings for receiving and securing substantially parallel shafts 72 and 74. Plate 70 includes an arcuate slot 76 contiguous at one end with a lobe-shaped slot 78.

Shaft 64 pivotally mounts a gas cylinder or shock 80 and a lever bracket 82. Shock 80 includes a piston rod 84 which is pivotally secured to shaft 72. Lever bracket 82 is an elongated member having a substantially U-shaped cross section forming pair of substantially parallel plates 86 and 88 (an edge of substantially hidden plate 88 is denoted by dashed lines. A shaft 90 secured between plates 86 and 88 at the terminal end of lever bracket 82 pivotally connects the inner end of stabilizer arm 22. A follower pin 92 projects from an intermediate portion of plate 88 and is received in slot 76 or contiguous slot 78 of plate 70. Shaft 74 preferably mounts a roller or follower 94 which is engageable against cam track 96. Cam track 96 is formed on a lower rear edge portion of A-frame member 34.

Shock 80 is a heavy duty gas cylinder which normally urges rod 84 outwardly. Because the end of rod 84 is pivotally secured to shaft 72, shock bracket 66 is normally urged upwardly in a counterclockwise direction as viewed in FIG. 6. When the voting booth is collapsed to the storage configuration, follower 94 rides cam track 96 in a path along the edge of member 34 generally from left to right along the cam track 96 in the illustrated position of FIG. 6. During the final stages of collapsing the voting booth wherein cover 14 is pivoted about hinge 16 to enclose base 12, the interaction of follower 94 with cam track 96 formed on A-frame member 34 results in the shock bracket 66 being forced rearwardly to a position which is slightly inclined. Lever bracket 82 is also urged in a clockwise position to the slightly inclined position of FIG. 6 by means of pin 92 following the arcuate slot 76 of plate 70 of the shock bracket 66. Stabilizer arm 22 is pivotally connected to lever bracket 82 by shaft 90 which thus results in the stabilizer arm 22 being retracted rearwardly to the storage position illustrated in FIG. 6. When the cover 14 is latched to base 12, member 34 fixes the position of follower 94. In accordance with the previously described assembly, arm 22 is consequently rigidly locked in position. As will become apparent from the description below, shock 80 functions to counterbalance the weight of the support assembly comprising the A-frame members 34, support panel 32, and support members 40 and of the voting console 36. Voting console 36 is essentially positioned in a nestled configuration relative to base 12 and the support assembly in the storage configuration of FIG. 6.

With further reference to FIG. 6, as the cover 14 is being pivoted (clockwise about hinge 16 as viewed in FIG. 6) to the closed storage configuration, it is desirable that the voting console 36 be latched to the support assembly to prevent the voting console from pivoting relative to the support assembly. A console pin 98 projects from each side of voting console 36. Console pin 98 is engageable with a narrow slot 100 formed in latch plate 102. Latch plate 102 is pivotally mounted to A-frame member 34 by means of a pivot pin 104 at an end of latch plate 102 generally opposite that of slot 100. A link pin 106 projects outwardly at an intermediate location of latch plate 102.

A cooperating link 108 is pivotally mounted to A-frame member 34 by means of a pivot pin 110 so that link 108 is pivotal around an intermediate axis. One end of link 108 forms a contoured slot 112 which interacts with shaft 74 as will be described below. The opposite end of link 108 forms a contoured engagement edge comprising a first contoured segment 114, a second coutoured segment 116 terminating in an arcuate catch, and an apex 115 separating the segments. Link pin 106 is engageable with the first and second edge segments 114 and 116, respectively, to provide for selective pivoting of latch plate 102 to thereby position slot 100 in either a latch or unlatch position relative to console pin 98. Link 108 and latch plate 102 further interact by means of a tension spring 118 which connects between link pin 106 and a fastener 120 secured to link 108.

In the latched position illustrated in FIG. 6, link 108 is in a substantially vertical position and latch plate 102 is in an oblique orientation relative to link 108 so that slot 100 is in a substantially horizontal position. Link 108 and latch plate 102 cooperate to latch console pin 98 and hence voting console in a fixed position relative to the support assembly. Latch plate 102 is prevented from clockwise pivoting about pin 104 by the engaging of link pin 106 against first edge segment 114 of link 108 and by tension spring 118 which acts to urge link 108 to the illustrated vertical orientation and to prevent pin 106 from riding over apex 115 to second edge segment 116. Console pin 98 which is captured in slot 100 locks voting console 36 against rotation by virtue of the fixed pivotal position of latch plate 102. It, of course, is appreciated that voting console 36 is pivotal at an intermediate location about the support assembly. Console pin 98 fixed to voting console 36 is essentially only movable in a substantially downward direction for the configuration illustrated in FIG. 6.

Figure 7:
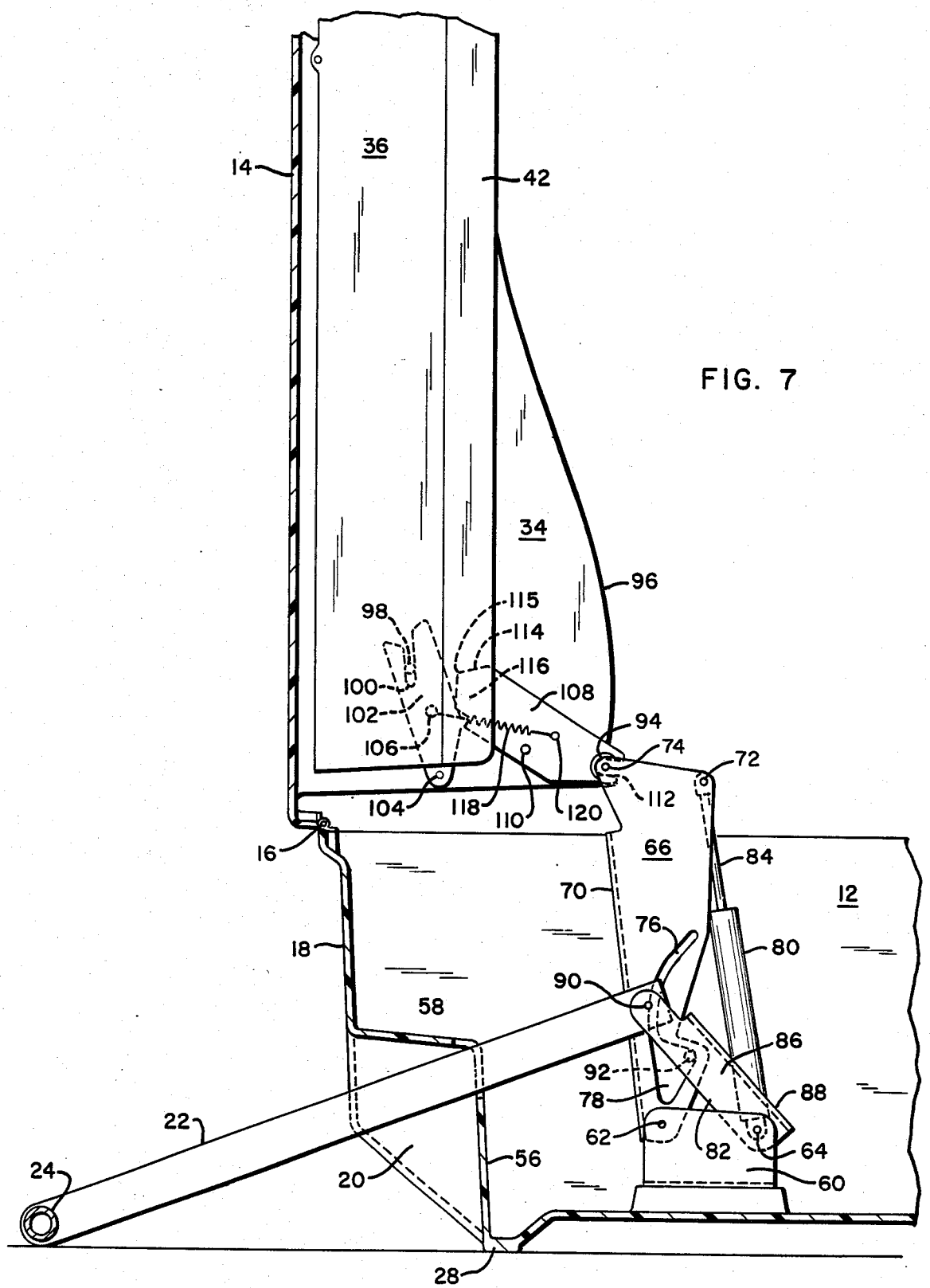
FIG. 7 is a side interior view of a portion of the portable voting booth in the configuration illustrated in FIG. 2, partially in phantom, illustrating the counterbalance/latch assembly of FIG. 6.
Figure 8:
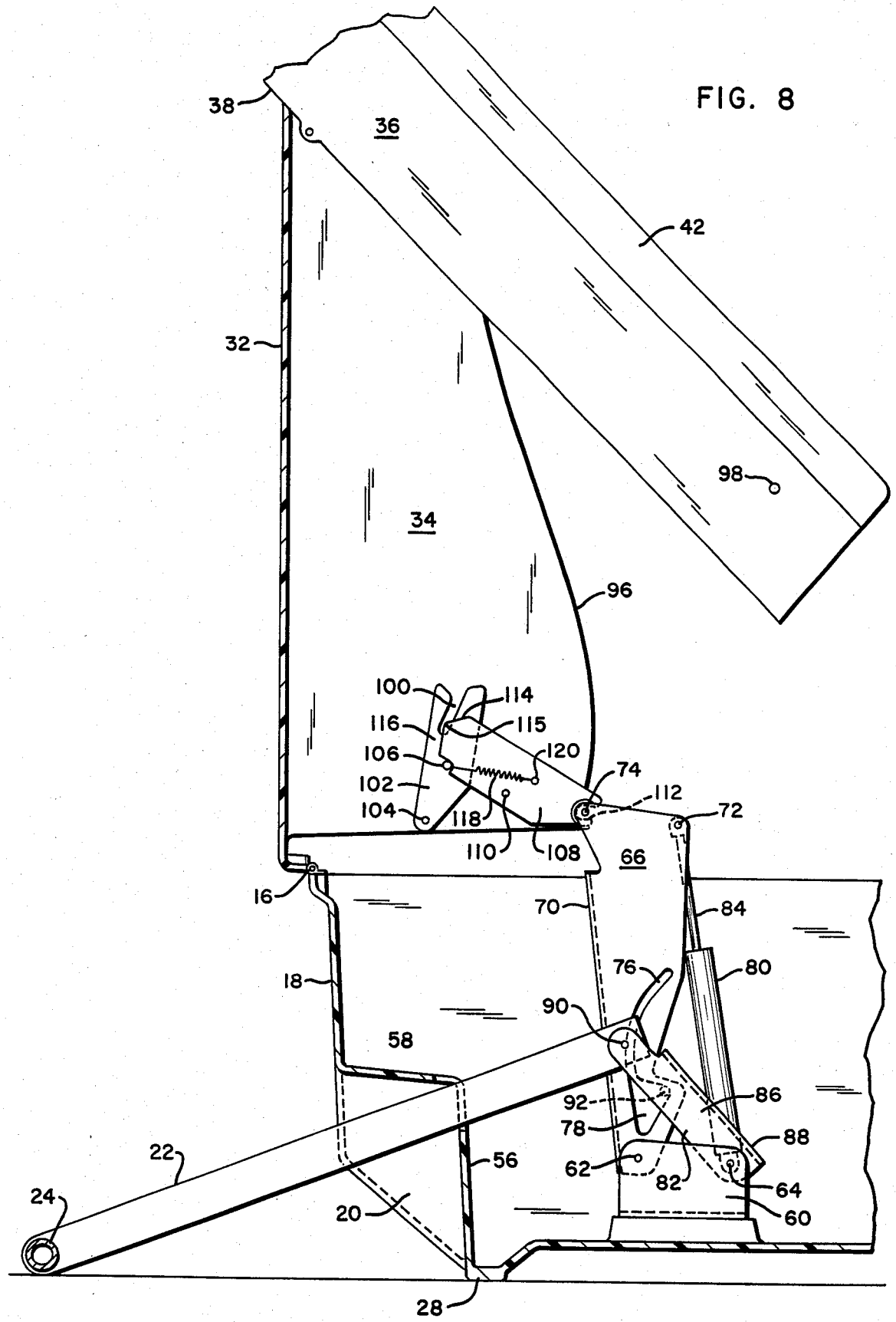
FIG. 8 is a side interior view of a portion of the portable voting booth in a configuration intermediate the configurations of FIG. 2 and FIG. 3, partially on phantom, illustrating the counterbalance/latch assembly of FIG. 6.

As the support assembly/voting console is pulled out of the base 12 to the position illustrated in FIG. 2, the weight of the support assembly and voting console are essentially counter balanced by shock 80 acting through follower 94 along cam track 96 until shaft 74 interferes with slot 112 of link 108. With reference to FIG. 7, link 108 is pivoted by the interaction of shaft 74 and slot 112 so that the first edge segment 114 disengages from link pin 106. Upon counterclockwise pivoting (as viewed in FIG. 7 and FIG. 8) of the voting console 36 from the support console, link pin 106 under the force of spring 118 moves over apex 115 and along the second contour segment 116 of link 108 to the open latch position illustrated in FIG. 8. Link pin 106 is essentially captured in the arcuate catch at the termination of second contour segment 116. Latch plate 102 is thereby pivoted to the open position so that console pin 98 is free to be pivotally withdrawn from slot 100 as illustrated in FIG. 8 on further subsequent pivoting of the voting console 36 to the position of FIG. 3. The portions of latch plate 102 adjacent slot 100 may be slightly beveled so that console pin 98 may be received in slot 100 or withdrawn from slot 100 even though the pin 98 and slot 100 are slightly out of alignment.

With reference to FIG. 8, the support assembly/voting console is latched in the upright configurations of FIG. 3 through FIG. 5 by means of the shock 80 acting through shaft 72 and bracket 66 to shaft 74 which is captured in slot 112 of link 108. Link 108 is pivotally fixed to a A-frame member 34 by virtue of the reception of shaft 74 in slot 112 and the engagement of link pin 106 against the downward oriented second segment 116.

With further reference to FIG. 7, when the support assembly is in the upright position, shock bracket 66 and shock 80 are also substantially uprightly positioned. Pin 92 of lever bracket 82 follows arcuate slot 76 and the upper edge of lobe slot 78 to the captured position of FIG. 7. Consequently, lever bracket 82 is pivoted (in a counterclockwise direction as viewed in FIG. 7), and stabilizer arms 22 are projected outwardly through slots 20 to the extended positions illustrated in the configuration of FIG. 5, FIG. 7, and FIG. 8.

Figure 10:
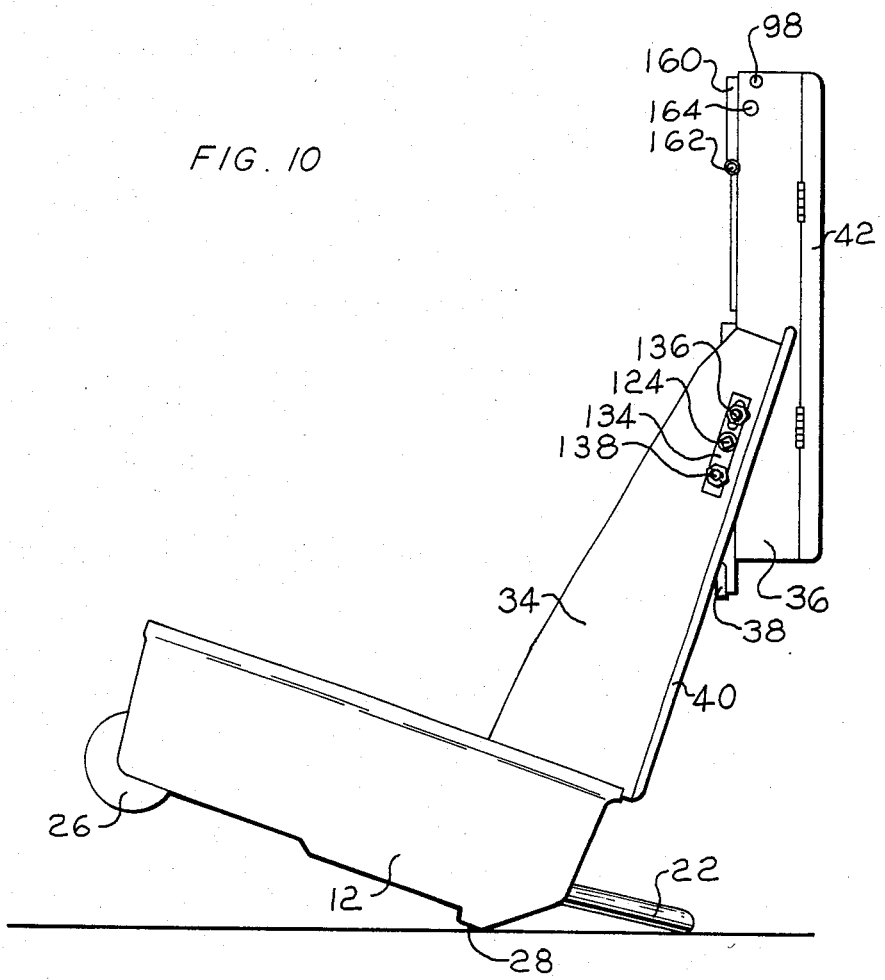
FIG. 10 is a side elevational view of the portable voting booth of the configuration of FIG. 3, the voting booth being illustrated in a mode wherein the booth is adapted for use by handicapped individuals.
Figure 11:
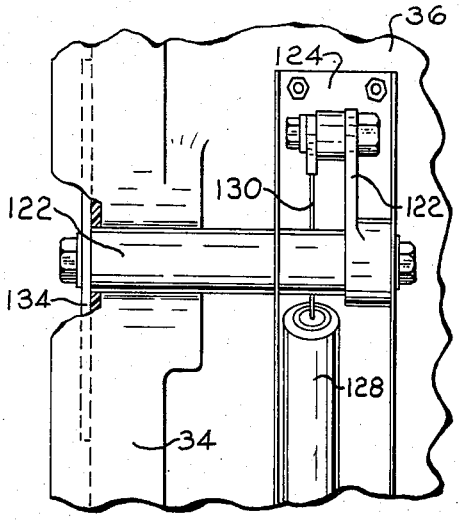
FIG. 11 is an enlarged interior rear view of a portion of the portable voting booth in the configuration of FIG. 5.
Figure 14:
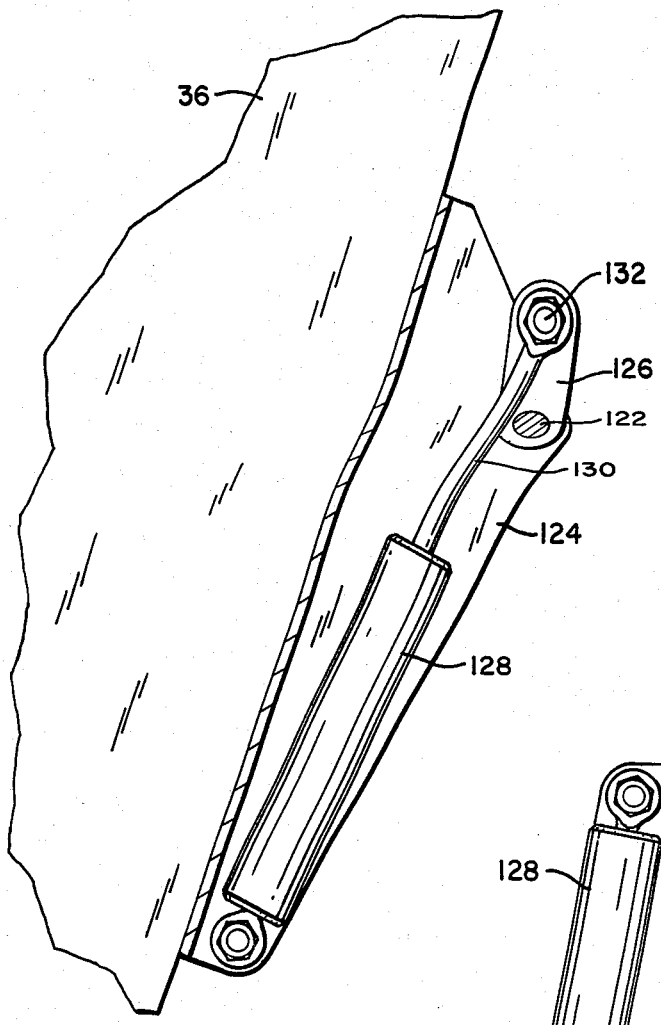
FIG. 14 is an enlarged side view illustrating a portion of a second counterbalance assembly employed in the portable voting booth, the counterbalance assembly position being illustrated for the voting booth configuration of FIG. 5.
Figure 15:
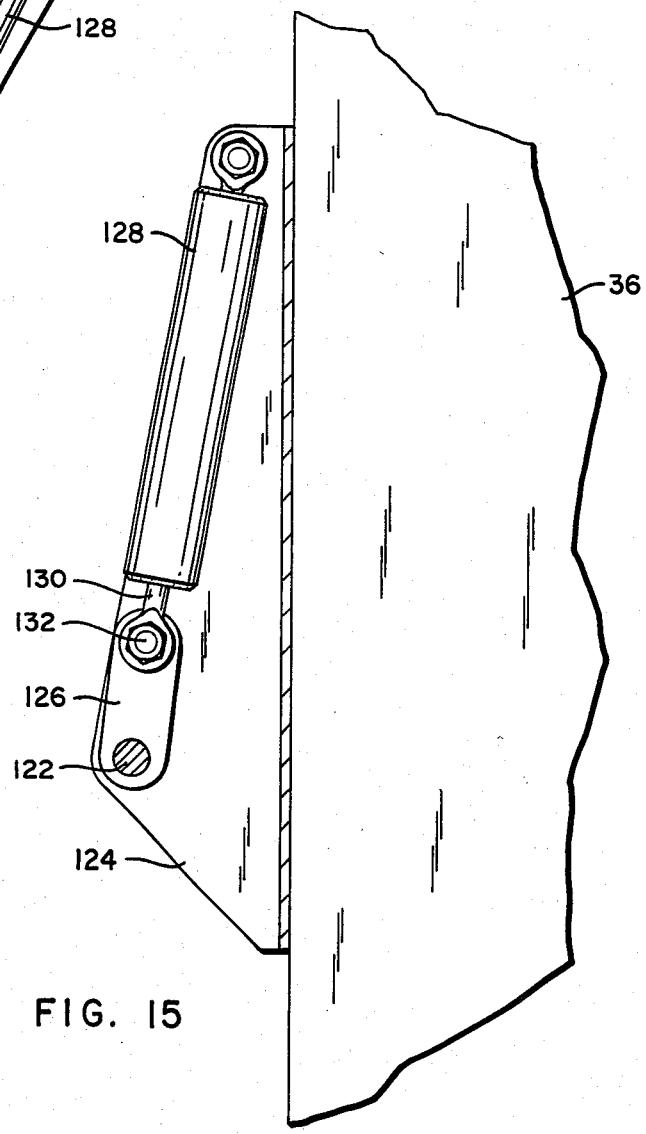
FIG. 15 is an enlarged side view of the counterbalance assembly of FIG. 14, the assembly position being illustrated for the voting booth configuration of FIG. 1.

With reference to FIG. 10 and FIG. 11, voting console 36 is pivotally mounted to A-frame members 34 by means of a pair of shafts 122 (only one being illustrated). A substantially U-shaped console bracket 124 is mounted interiorly of voting console 36. One end of shaft 122 is received at opposite sides of bracket 124. A crank 126 is mounted to shaft 122 interior of console bracket 124. With additional reference to FIG. 14 and FIG. 15, console bracket 124 also pivotally mounts an air cylinder or second shock 128 having a piston rod 130. The outer end of rod 130 is pivotally mounted to a pin 132. Pin 132 also pivotally secures the terminal end of crank 126. Shock 128 functions as a counter balancing means which urges the voting console to the upright slightly inclined operational position illustrated in the configuration of FIGS. 3–5. The latter counterbalancing means in the voting configuration is illustrated in FIG. 14. In the retracted configurations of FIG. 2 and FIG. 7, rod 130 is forced into shock 128 by virtue of crank 126 as illustrated in FIG. 15. In a preferred form of the invention, a counterbalancing assembly as previously described is also mounted at the opposite side of the voting console 36.

A-frame member 34 is provided with an opening for receiving the outer end of shaft 122. The ends of shaft 122 may be of a reduced diameter of facilitate the securing of the shaft. Because of the relatively bulky and top-heavy nature of the previously described voting console and because the voting booth requires a number of coordinated movements for effective operation, it is important that the pivotal axis of the voting console 36 be accurately located relative to the support assembly. Preferably, a locating plate 134 defining a centrally located yoke for receiving the outer end of shaft 122 is mounted to the exterior side of A-frame 34. Plate 134, and hence shaft 122, is accurately positioned relative to A-frame member 34 by means of a pair of oppositely positioned eccentric adjustment pins 136 and 138. One of the eccentric pins provides for adjustment of the locating plate 134 in a vertical orientation and the other eccentric pin provides for adjustment in a horizontal orientation. By suitably adjusting eccentric pins 136 and 138, a fine adjustment to the location of the voting console/support assembly pivot axis may be efficiently obtained. A shaft/pivot assembly substantially identical to that previously described is also provided at the opposite sides of the support assembly and voting console.

Figure 12:
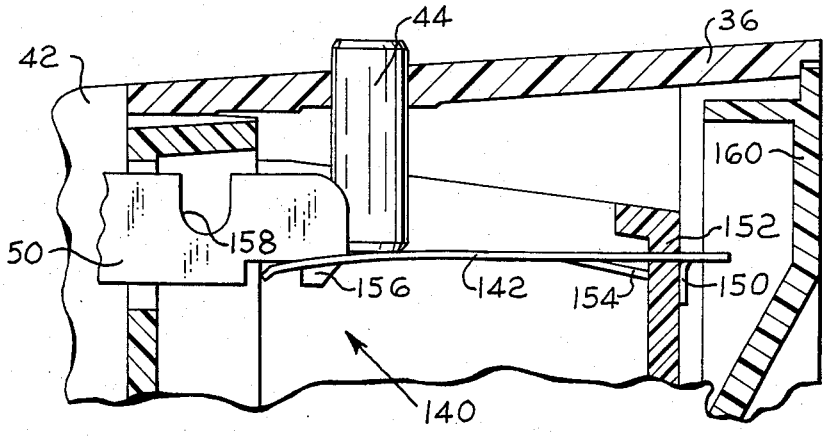
FIG. 12 is a side sectional view of an upper central portion of the portable voting booth in the configuration of FIG. 3, further illustrating in detail a latch mechanism employed in the present invention.
Figure 13:
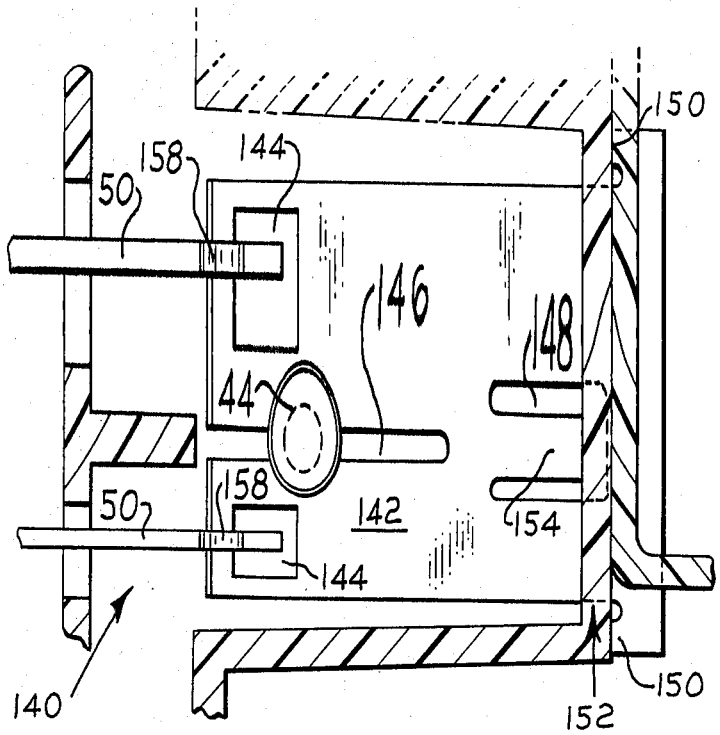
FIG. 13 is a top view, partially broken away, illustrating the latch mechanism of FIG. 12.

Front panels 42 are preferably latched in the closed position illustrated in FIG. 3 by means of a novel latch assembly designated generally by the numeral 140 and illustrated in FIG. 12 and FIG. 13. Latch assembly 140 comprises a substantially rectangular resilient latch plate 142 rearwardly forming a pair of side extensions to substantially form a T-shape. Latch plate 142 includes at a forward portion a pair of recesses 144. An elongated slot 146 extends rearwardly from a slightly inclined front edge of latch plate 142 between the recesses 144 to forwardly bifurcate plate 142. A substantially U-shaped centrally located slot 148 is formed rearwardly from the rear terminus of slot 146. The extensions at the rear of plate 142 include a pair of forwardly extending tab portions 150. A central top portion of the interior front panel structure of voting console 36 is provided with a narrow a slot 152. The width of the slot 152 is substantially commensurate with the forward width of latch plate 142. The foregoing described latch plate 142 is mounted to the voting console by inserting the latch plate from the rear of the slot 152 and projecting the plate forwardly until the tab portions 150 are turned down and forced against the back of the interior front panel structure. The portion of the plate interior of U-shaped slot 148 is turned down to form an opposing retainer 154 which engage against the front face of the front panel structure. The latch plate 142 thus projects forwardly from the interior of the voting console 36.

Latch plate 142 is sufficiently resilient that the forward portion will naturally tend to spring back to the position of FIG. 13 upon vertical displacement. Each of front panels 42 is provided at an upper rear portion with a transversely projecting latch/support 50. Each of the latch/supports 50 are engageable with latch plate 142. Latch/support 50 includes a downwardly extending tang 156 which is coutoured and positioned so that when the front panels are closed, tang 156 rides up over the front portion of latch plate 142 until the tang is received in a recess 144. The vertical edge of each tang 156 thus engages the edge of a recess 144 to latch each of the panels in a closed position. Because of the bifurcated front portion of latch plate 142, each recess 144 of the latch plate essentially provides an independent latching means for each of the front panels 42 so that the panels may be independently latched. Button 44 centrally located at the top of the voting console engages against the top of latch plate 142. Latch plate 142 essentially acts as a leaf spring to normally bias button 44 upwardly to a latched position. The latch assembly 140 may be efficiently unlatched by downwardly depressing button 44. Button 44 forces latch plate 142 downwardly whereby each tang 156 is free to clear the edge of each recess 144.

Latch/support member 50 also includes an upwardly opening U-shaped groove 158. When the front panels 42 are pivoted to the open position of FIG. 4, each curtain rod 48 being pivotally mounted at one end to the top portion of the interior front panel structure of the voting console is accessible for manual positioning. The curtain rods 48 are supported in place by suspending the rods across the U-shaped grooves 158 of the projecting latch/supports 50. A foldable substantially C-shaped curtain rod extension 54 having a flared portion at each end and mounting a curtain 52 may then be mounted in place by sliding the flared portions over the free ends of rods 48 to provide a voting booth essentially as illustrated in FIG. 5.

The voting console 36 is retained in a stable, slightly inclined orientation relative to the support assembly by means of the lower portion of the rear panel 38 of the voting console 36 abutting against the top portion of support panel 32. In addition, the front panels 42 contact against support members 40 to prevent the pivoting of voting console 36 in the opposite direction. The front panels 42 are essentially secured in the latter fixed position by means of the foregoing described curtain assembly.

The portable voting booth of the present invention is particularly adapted for use with an electronic voting means employing a membrane-type display means for a keyboard system employing one or more matrix modules mounted over one or more suitably assembled circuit boards such as disclosed in copending application Ser. No. 543,390 filed Oct. 19, 1983 assigned to the assignee of the present invention. The front interior panel structure voting console 36 may therefore include means for mounting such circuit boards, matrix modules and a membrane-type display panel as well as various electronics circuitry and auxiliary equipment as required. The interior front panel means may include a ballot display 46, a door 166 for accessing a write-in ballot pad, and a vote button 168 for ultimately recording the provisionally selected votes designated by the voter on a keyboard system employed with the ballot display. The voting console 36 may have a rear covering 160 which is hinged by means of an elongated hinge 162. Rear cover 160 is preferably sealed or locked in the closed position during the period when the booth is employed for voting purposes. Subsequent to the closing of the polls, cover 160 may be unlocked and pulled downwardly to access various recorded information such as raw voting data or a compilation of the voting results in disk or tape form, or a paper tape to which write-in ballots have been inscribed. The exterior side of the voting console may also be provided with a rubber stop 164 which prevents the voting console from misaligning and contacting the interior sides of the support assembly or the latching assembly when the voting booth is collapsed as previously described.

Figure 9:
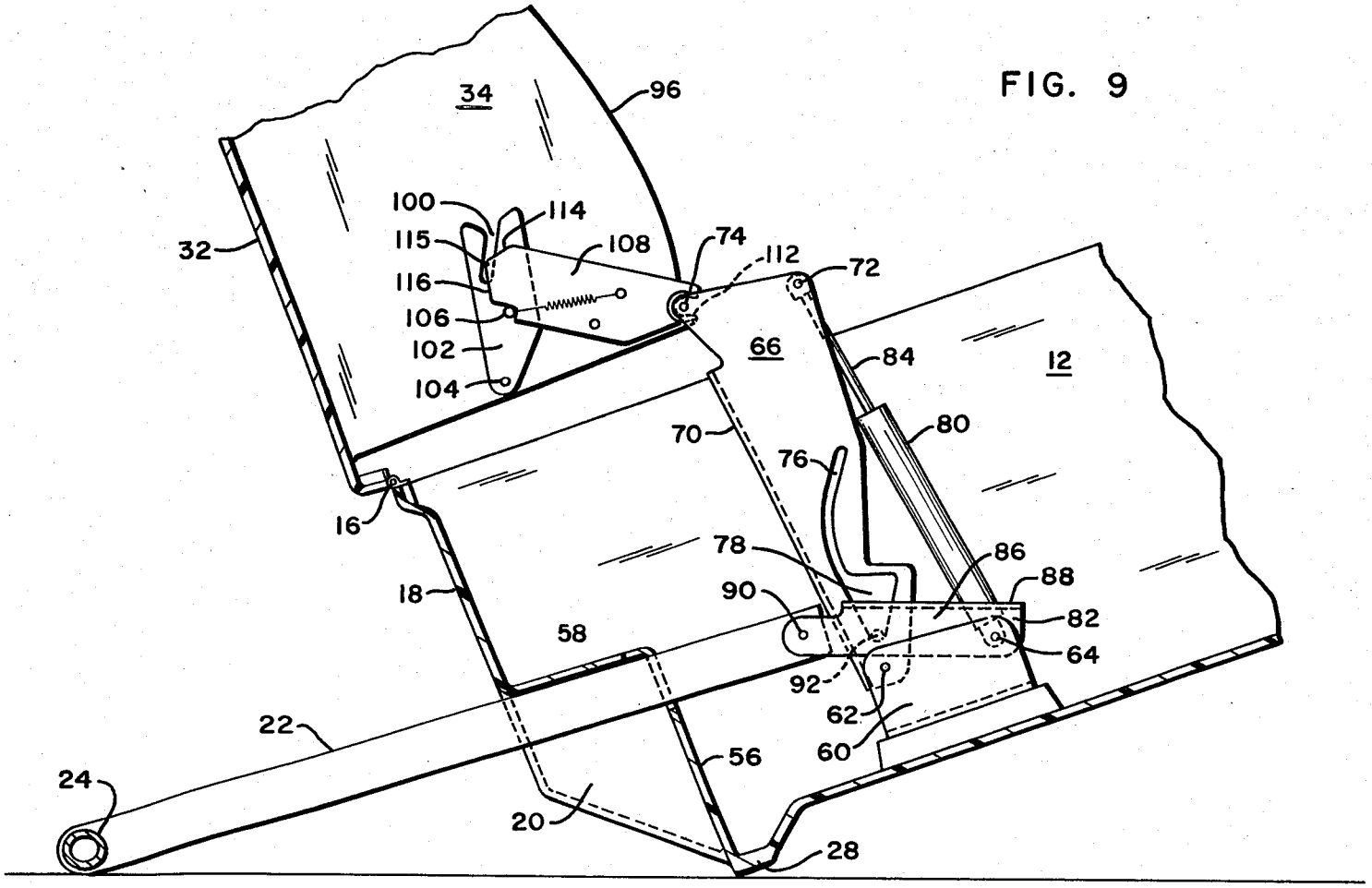
FIG. 9 is a side interior view of a portion of the portable voting booth in the configuration of FIG. 5, partially in phantom, illustrating the counterbalance/latch assembly of FIG. 6, the voting booth being further positioned in a mode wherein the booth is especially adapted for use by handicapped individuals.

With further reference to FIG. 9 and FIG. 10, an additional feature of the portable voting booth of the present invention is a provision whereby the ballot display may be lowered to a position for ready access to handicapped voters, in particular, voters who are confined to a wheelchair. The drawings of FIG. 9 and FIG. 10 illustrate the voting booth 10 in a lowered position wherein the voting booth is tipped forwardly so that the booth is lowerly supported by means of the stabilizer bar 24 and the feet 28 at the bottom of the base 12. In this latter handicapped mode, the ballot display 46 is essentially oriented in a lowered vertical position as opposed to the normally slightly inclined position for facilitating the display to a person in a normally standing position such as illustrated in FIG. 4 and FIG. 5. In the handicapped mode, the stabilizer arms 22 are forced slightly downwardly relative to the base 12, pin 92 of lever bracket 82 being forced downwardly to the lower slot position of slot 78 shown in FIG. 9. The portable voting booth of the present invention has a center of gravity which permits the booth being positioned in a stable orientation in both the handicapped mode of FIG. 10 and the normal voting mode of FIG. 5.

The foregoing described portable voting booth has been set forth for purposes of illustration of a preferred embodiment of the invention and should not be deemed a limitation of the invention herein. Accordingly, various modifications, adaptations, and alternatives may occur to one skilled in the art without departing from the spirit and scope of the present invention.

What is claimed is:

1. A portable voting booth expandable from a storage mode to a voting mode and collapsable from said voting mode to said storage mode comprising:

a base storage container;

a support console pivotally mounted to said container;

a voting console having a ballot display means and pivotally mounted to said support console;

a booth means connected to said voting console and expandable to visually isolate said ballot display means;

said booth means, voting console, and support console being receivable in nestled relationship within said storage container in a storage mode and being expandable to a stable voting mode wherein said ballot display means is presented in a generally upright position relative to said container and said ballot display means is visually isolatable by said booth means.

2. The portable voting booth of claim 1 wherein said container has a generally box-like form and said support console forms a lid for said container in the storage mode.

3. The portable voting booth of claim 1 further comprising a pair of wheels mounted to said container.

4. The portable voting booth of claim 1 wherein said container includes a front panel having a pair of slots, and said booth comprises a pair of arms extending outwardly through said slots, said arms mounting a stabilizer bar.

5. The portable voting booth of claim 4 wherein said container further includes a rear panel, said booth being adapted in the storage mode for being uprightly supported on said rear panel.

6. The portable voting booth of claim 1 wherein said container provides a base support for said booth in the voting mode.

7. The portable voting booth of claim 1 wherein said container further includes a storage compartment means.

8. The portable voting booth of claim 4 wherein the voting mode of said ballot display means may be forwardly lowered to a stable handicapped position.

9. The portable voting booth of claim 8 wherein said stabilizer bar supports said booth in the handicapped position.

10. The portable voting booth of claim 9 further comprising shifter means for retracting said stabilizer bar to a retracted position in the storage mode and projecting said bar to an extended position in the voting mode.

11. The portable voting booth of claim 1 wherein said support console comprises a pair of side frame members connected to opposite sides of a front support panel.

12. The portable voting booth of claim 11 wherein the voting console has a substantially box-like shape including two side panels, and a rear panel.

13. The portable voting booth of claim 12 wherein the voting console is pivotally mounted to the support console at intermediate locations in opposite side panels of the voting console.

14. The portable voting booth of claim 13 wherein in the voting mode said voting console is slightly inclined relative to said support console, said rear panel contacting a portion of the front support panel.

15. The portable voting booth of claim 1 wherein the voting console is pivoted from the support console to expand the booth from the storage mode to the voting mode.

16. The portable voting booth of claim 13 further comprising pivot adjustment means on the support console to adjust the pivot axis of the voting console.

17. The portable voting booth of claim 15 wherein the voting console further includes counterbalancing means to facilitate pivoting of the voting console.

18. The portable voting booth of claim 1 wherein the support console is hinged to the container.

19. The portable voting booth of claim 15 further comprising a console latch means for latching the voting console to the support console when the voting booth is collapsed to the storage mode.

20. The portable voting booth of claim 1 wherein when said booth is expanded from the storage mode to the voting mode, the support console is pivoted from said container to a generally upright position relative to said container.

21. The portable voting booth of claim 20 further comprising support counterbalancing means to facilitate pivoting of the support console from the container.

22. The portable voting booth of claim 20 further comprising support latch means to latch the support console in said generally upright position.

23. The portable voting booth of claim 21 wherein the counter balancing means acts against a cam track formed on said support console.

24. The portable voting booth of claim 1 wherein said booth means comprises a pair of front panels hinged to said voting console.

25. The portable voting booth of claim 24 further comprising panel latch means for latching said panels to said voting console.

26. The portable voting booth of claim 25 wherein said booth means further comprises a pair of curtain rods pivotally mounted to said voting console and foldable into said voting console in the storage mode.

27. The portable voting booth of claim 26 wherein in said voting mode said front panels are forwardly opened and each said curtain rod is supported in a fixed extended position on a curtain support projecting from a said front panel.

28. The portable voting booth of claim 27 wherein in said voting mode said front panels contact against the support console to act to prevent pivoting of the voting console relative to the support console.

29. The portable voting booth of claim 28 further comprising a curtain rod extension connecting said foldable curtain rods and a curtain suspended from said extension.

30. The portable voting booth of claim 27 further comprising a latch member projecting from each of said front panels, said latch member being said curtain support and a component of said panel latch means.

31. The portable voting booth of claim 25 wherein said panel latch means comprises a resilient bifurcated plate forming a pair of recesses and a button means received in the voting console to unlatch said latch means upon depression thereof.

32. The portable voting booth of claim 1 wherein the ballot display means includes a membrane-type ballot display.

33. A portable voting booth positionable in a compact storage mode and an expanded voting mode comprising:

a base means;

a support console pivotally mounted to said base means;

a voting console pivotally mounted to said support console and having a ballot display;

a panel means connected to said voting console and expandable to provide a booth means to visually isolate said ballot display.

34. The portable voting booth of claim 33 wherein said support console is pivotal to a stable upright position relative to said base means.

35. The portable voting booth of claim 34 wherein said voting console is pivotal to a stable slightly inclined position relative to said support console.

36. The portable voting booth of claim 33 wherein the panel means comprises a pair of doors hinged to said voting console.

37. The portable voting booth of claim 36 wherein the booth means comprises said doors and a curtain suspended from a curtain rod means supported by said doors.

38. The portable voting booth of claim 33 wherein in said voting mode said base means forms a generally horizontally disposed base support, said support console and voting console being generally upright relative to said base means, and said booth means being rearwardly supported and forming a generally forward overhang structure.

39. The portable voting booth of claim 38 wherein said base means forms a container, said support console, voting console, and panel means being received in said container in a storage mode.

40. A portable voting booth positionable in a compact storage mode and an expanded voting mode comprising:

base means to enclose said booth in a storage mode and support said booth in a voting mode;

voting means including a ballot display receivable in said base means in a storage mode and pivotally expandable to present the ballot display in a generally upright position relative to said base means in a voting mode; and panel means pivotally connected to said voting console and pivotally expandable to form a booth to visually isolate said ballot display in the voting mode.

* * * * *